US005209966A

United States Patent [19]

Lange et al.

[11] Patent Number: 5,209,966

[45] Date of Patent: May 11, 1993

[54] TREATED POLYMER FABRICS

[75] Inventors: Richard M. Lange, Euclid; Arturs Grava, Mayfield Heights, both of Ohio

[73] Assignee: The Lubrizol Corporation, Wickliffe, Ohio

[21] Appl. No.: 494,063

[22] Filed: Mar. 15, 1990

[51] Int. Cl.[5] ..... D06M 13/322; B05D 3/02; C11D 1/28

[52] U.S. Cl. ..... 428/272; 8/115.6; 8/115.51; 8/194; 428/289; 427/384; 427/394; 427/395; 252/8.6; 252/8.75; 252/8.8; 252/8.9; 562/555; 562/564; 562/567; 554/63; 554/227; 564/95

[58] Field of Search ..... 428/224; 8/115.6, 115.51, 8/196; 162/158, 179; 427/384, 394, 395; 252/8.6, 8.75, 8.8, 8.9; 562/555, 564, 567; 260/400, 401; 564/95

[56] References Cited

U.S. PATENT DOCUMENTS

| | | | |
|---|---|---|---|
| 3,973,068 | 8/1976 | Weber | 428/212 |
| 4,094,796 | 6/1978 | Schwartz | 252/8.8 |
| 4,578,066 | 3/1986 | O'Connor | 604/366 |
| 4,738,676 | 4/1988 | Osborn, III | 604/385 |
| 4,753,834 | 6/1988 | Braun et al. | 428/74 |
| 4,915,786 | 4/1990 | Sweeney | 162/158 |
| 4,957,645 | 9/1990 | Emert et al. | 252/47.5 |

*Primary Examiner*—George F. Lesmes
*Assistant Examiner*—Kathryne E. Shelborne
*Attorney, Agent, or Firm*—David M. Shold; Forrest L. Collins

[57] ABSTRACT

This invention relates to an article comprising:

(A) a polymer fabric treated with (B) a wetting agent which comprises at least one compound of the formula

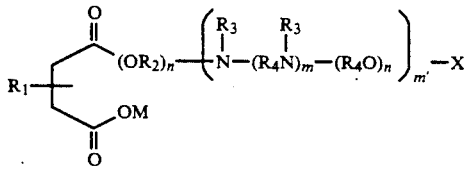

wherein $R_1$ is a hydrocarbyl group having about 8 to about 150 carbon atoms; $R_2$ is a hydrocarbylene group, or a hydroxy substituted or hydroxyalkyl substituted hydrocarbylene; each $R_3$ is independently hydrogen, an alkyl group, a hydroxyalkyl group, a hydrocarbylcarbonyl or a polyoxyalkylene group; each $R_4$ is independently a hydrocarbylene group; each n is independently 1 to 150; m is zero or one; m' is zero or one; M is a hydrogen, an ammonium cation or a metal cation, and when m' is zero, X is —H, —Ar, —OH, —$OR_5$,

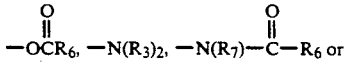

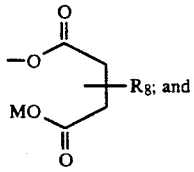

when m' is one, X is —H, —$R_5$,

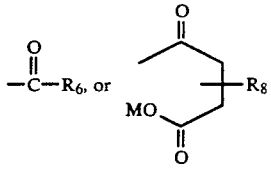

wherein each $R_5$, $R_6$ and $R_8$ is independently a hydrocarbyl group having up to 100 carbon atoms; $R_7$ is hydrogen or an alkyl group having from 1 to about 8 carbon atoms and Ar is a phenyl group.

The treated polymer fabrics of the present invention have improved wicking/wetting characteristics. Further, the treated polymer fabrics maintain these characteristics upon repeated exposure to fluids.

45 Claims, No Drawings

TREATED POLYMER FABRICS

FIELD OF THE INVENTION

This invention relates to treated polymer fabrics.

BACKGROUND OF THE INVENTION

Polymer fabrics are extensively used in a wide variety of products, ranging from disposable towel sheets to sanitary napkins and from disposable diapers to surgical sponges. All these applications involve the absorption of water or aqueous liquids (urine, blood, lymph, spills of coffee, tea, milk, etc.). The fabrics must have good wicking properties, i.e., water must be readily taken up and spread.

Polymer fabrics are generally hydrophobic. It is desirable to improve the wicking/wetting ability of the polymer fabrics. Often wetting agents are used to improve the ability of the polymer fabric to pass water and bodily fluids through the polymer fabric and into an absorbant layer. Further, it is desirable that the polymer fabric maintain its wicking/wetting characteristics after repeated exposure to water or aqueous liquids.

SUMMARY OF THE INVENTION

This invention relates to an article comprising:

(A) a polymer fabric treated with (B) a wetting agent which comprises at least one compound of the formula

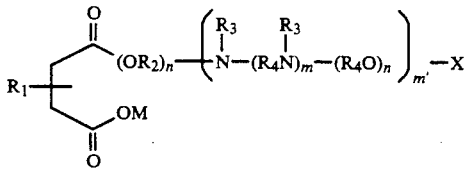

wherein $R_1$ is a hydrocarbyl group having about 8 to about 150 carbon atoms; $R_2$ is a hydrocarbylene group, or a hydroxy substituted or hydroxyalkyl substituted hydrocarbylene; each $R_3$ is independently hydrogen, an alkyl group, a hydroxy alkyl group, a hydrocarbylcarbonyl or a polyoxyalkylene group; each $R_4$ is independently a hydrocarbylene group; each n is independently 1 to 150; m is zero or one; m' is zero or one; M is a hydrogen, an ammonium cation or a metal cation, and when m' is zero, X is —H, —Ar, —OH, —$OR_5$,

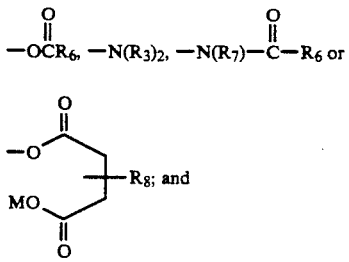

when m' is one, X is —H, —$R_5$,

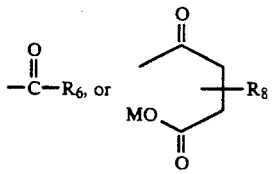

wherein each $R_5$, $R_6$ and $R_8$ is independently a hydrocarbyl group having up to 100 carbon atoms; $R_7$ is hydrogen or an alkyl group having from 1 to about 8 carbon atoms and Ar is a phenyl group.

The treated polymer fabrics of the present invention have improved wicking/wetting characteristics. Further, the treated polymer fabrics maintain these characteristics upon repeated exposure to aqueous fluids.

DESCRIPTION OF THE PREFERRED EMBODIMENTS

The polymer fabrics which are treated with wetting agents may be any polymer fabric, preferably a woven or nonwoven fabric, more preferably a nonwoven fabric. The polymer fabric may be prepared by any method known to those skilled in the art. When the fabric is nonwoven, it may be a spunbonded or melt-blown polymer fabric, preferably a spunbonded fabric. Spin-bonding and melt-blowing processes are known to those in the art.

The polymer fabric may be prepared from any thermoplastic polymer. The thermoplastic polymer can be a polyester, polyamide, polyurethane, polyacrylic, polyolefin, combinations thereof, and the like. The preferred material is polyolefin.

The polyolefins are polymers which are essentially hydrocarbon in nature. They are generally prepared from unsaturated hydrocarbon monomers. However, the polyolefin may include other monomers provided the polyolefin retains its hydrocarbon nature. Examples of other monomers include vinyl chloride, vinyl acetate, acrylic acid or esters, methacrylic acid or esters, acrylamide and acrylonitrile. Preferably, the polyolefins are hydrocarbon polymers. The polyolefins include homopolymers, copolymers and polymer blends.

Copolymers can be random or block copolymers of two or more olefins. Polymer blends can utilize two or more polyolefins or one or more polyolefins and one or more nonpolyolefin polymers. As a practical matter, homopolymers and copolymers and polymer blends involving only polyolefins are preferred, with homopolymers being most preferred.

Examples of polyolefins include polyethylene, polystyrene, polypropylene, poly(1-butene), poly(2-butene), poly(1-pentene), poly(2-pentene), poly(3-methyl-1-pentene), poly(4-methyl-1-pentene), poly-1,3-butadiene and polyisoprene, more preferably polyethylene an polypropylene.

The polymer fabric is treated with a wetting agent to improve the hydrophilic character of the fabric. The wetting agents used in the present invention are compounds of the formula given above.

Preferably $R_1$ is a hydrocarbyl group having from about 8 to about 150 carbon atoms, more preferably about 8 to about 100, more preferably from about 8 to about 50, more preferably from about 8 to about 30, more preferably about 8 to about 24, more preferably about 10 to about 18 carbon atoms. Preferably, $R_1$ is an alkyl group, an alkenyl group, a polyalkene group or mixtures thereof, more preferably an alkyl or alkenyl group. When $R_1$ is a polyalkene group, the polyalkene group is characterized as having a number average molecular weight (Mn) of about 400 to about 2000, more preferably 800 to about 1500, more preferably 900 to about 1100.

Each $R_5$, $R_6$ and $R_8$ is independently a hydrocarbyl group having up to about 100 carbon atoms, more preferably 2 to about 50, more preferably about 8 to about 30, more preferably about 8 to about 24. In one embodiment, each $R_5$ is independently an alkyl or alkenyl group. Preferably $R_5$ contains from 1 to about 28 carbon atoms, more preferably 1 to about 18, more preferably 1 to about 12.

In another embodiment, each $R_6$ is independently an alkyl or alkenyl group, a polyalkene group, or mixtures thereof. When $R_6$ is a polyalkene group, the group is defined the same as $R_1$.

In another embodiment, $R_8$ is a group defined the same as $R_1$.

Ar is an phenyl group. The phenyl group may be substituted with a hydrocarbyl group or a polyoxyalkylenyl group. The hydrocarbyl group may contain 2 to about 18 carbon atoms, more preferably about 6 to about 12, more preferably about 9. The polyoxyalkylenyl group is preferably a polyoxyethylenyl or polyoxypropylenyl group.

$R_2$ is a hydrocarbylene, or a hydroxy substituted or hydroxyalkyl substituted hydrocarbylene. Preferably $R_2$ is an alkylene group having from 2 to about 8 carbon atoms, more preferably 2 to about 4; or hydroxy substituted or hydroxyalkyl substituted alkylene having from 2 to about 10 carbon atoms, more preferably about 4 to about 6 carbon atoms. When $R_2$ is an alkylene group, it is preferably an ethylene or propylene group.

Each $R_3$ is independently hydrogen, an alkyl group, a hydrocarbylcarbonyl group or a polyoxyalkylene group. Preferably each $R_3$ is independently a hydrogen; an alkyl group having from 1 to about 20 carbon atoms, more preferably 1 to about 8; a hydroxy alkyl group having from 1 to about 8 carbon atoms, more preferably from 1 to about 4; a hydrocarbyl carbonyl group having from 1 to about 28 carbon atoms in the hydrocarbyl group, more preferably about 8 to about 30, more preferably about 8 to about 24; or a polyoxyethylene group, a polyoxypropylene group, or mixtures thereof, more preferably polyoxyethylene group.

In one embodiment each $R_3$ is independently an alkyl or alkenyl carbonyl group. The alkyl or alkenyl group is preferably a methyl, ethyl, propyl, butyl, hexyl, octyl, decyl, dodecyl, tetradecyl, hexadecyl, octadecyl, decenyl, dodecenyl, tetradecenyl, hexadecenyl, or octadecenyl group.

In another embodiment, each $R_3$ is independently an alkyl or alkenyl group. The alkyl or alkenyl group is preferably an ethyl, propyl, butyl, hexyl, octyl, decyl, dodecyl, tridecyl, tetradecyl, hexadecyl, octadecyl, oleyl, tallow or soya group.

In another embodiment, each $R_3$ is independently a hydroxyalkyl group. Preferably the hydroxyalkyl group is hydroxymethyl or hydroxyethyl group, more preferably hydroxyethyl.

Each $R_4$ is independently a hydrocarbylene group. Preferably each $R_4$ is independently an alkylene group having from 1 to about 8, more preferably 2 to about 4 carbon atoms. Preferably, each $R_4$ is independently ethylene or propylene.

$R_7$ is hydrogen or an alkyl group having from 1 to about 8 carbon atoms. Preferably $R_7$ is hydrogen or a methyl, ethyl, propyl, butyl or hexyl group, more preferably hydrogen or methyl group, more preferably hydrogen.

Each n is independently 1 to about 150. Preferably each n is independently 1 to about 150, more preferably 2 to about 50, more preferably 2 to about 20, more preferably from about 3 to about 10.

m equals zero or one. m' equals zero or one. In one embodiment, m' equals zero and X is preferably —OH, —$OR_5$,

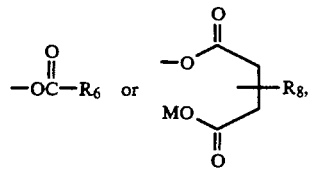

more preferably

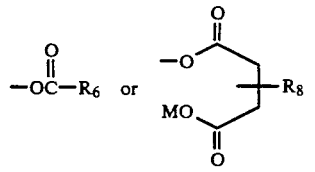

wherein $R_1$, $R_5$, $R_6$, $R_8$ and M are as defined previously.

In another embodiment, m' equals one, m equals one and X is preferably

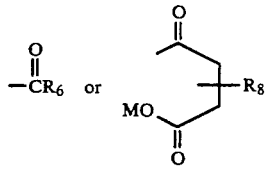

wherein $R_1$, $R_6$, $R_8$ and M are as defined previously.

In another embodiment, m' equals zero, n equals one, $R_2$ is a hydroxy substituted or hydroxyalkyl substituted hydrocarbylene group and X is preferably —OH,

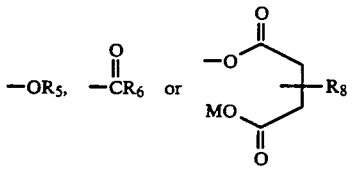

wherein $R_1$, $R_5$, $R_6$, $R_8$ and M are as defined previously.

The wetting agents used in the present invention are prepared by the reaction of at least one polycarboxylic acid or anhydride with at least one hydroxy compound to form an ester-acid. The ester-acid has at least one ester and at least one acid group.

The polycarboxylic acids are carboxylic acids or anhydrides having from 2 to about 4 carbonyl groups. The polycarboxylic acids of the present invention are preferably dimer acids, trimer acids or substituted succinic acids or anhydrides.

The dimer and trimer acids are the products resulting from the dimerization and trimerization of unsaturated fatty acids. Preferably the dimer acids are carboxylic acid products of the dimerization of $C_8$ to $C_{26}$ monomeric unsaturated fatty acids such as described in U.S. Pat. Nos. 2,482,760, 2,482,761, 2,731,481, 2,793,219, 2,964,545, 2,978,468, 3,157,681, and 3,256,304, the entire disclosures of which are incorporated herein by reference. Examples of the dimerized $C_8$ to $C_{26}$ monomeric unsaturated fatty acids include but are not limited to such products as Empol® 1014 Dimer Acid and Empol® 1016 Dimer Acid each available from Emery Industries, Inc.

In another embodiment, the polycarboxylic acids are diacids which are the carboxylic acid products of the Diels-Alder type reaction of an unsaturated fatty acid with alpha,beta-ethylenically unsaturated carboxy acid (e.g., acrylic, methacrylic, maleic or fumaric acids) such as are taught in U.S. Pat. No. 2,444,328, the disclosure of which is incorporated herein by reference, and the Diels-Alder adduct of a three to four carbon atom alpha,beta-ethylenically unsaturated alkyl monocarboxylic or dicarboxylic acid (e.g., acrylic and fumaric acids respectively) and pimeric or abietic acids. Examples of the carboxylic acid product of a Diels-Alder type reaction include Westvaco® Diacid 1525 and Westvaco® Diacid 1550, both being commercially available from the Westvaco Corporation.

In a preferred embodiment the polycarboxylic acids or anhydrides are succinic acids or anhydrides having a hydrocarbyl group. The hydrocarbyl group is defined the same as $R_1$ above. The hydrocarbyl group may be an octyl, decyl, dodecyl, tridecyl, tetradecyl, hexadecyl, octadecyl, dodecenyl, tetradecenyl, hexadecenyl, octadecenyl, oleyl, tallow or soya group.

In one embodiment the hydrocarbyl group is derived from monoolefins having from about 2 to about 30 carbon atoms or oligomers thereof. The oligomers are generally prepared from olefins having less than 7 carbon atoms, preferably ethylene, propylene or butylene, more preferably propylene. When the hydrocarbyl group is derived from an oligomer, the oligomer usually has from about 8 to about 30 carbon atoms. A preferred oligomer group has 12 carbon atoms and is a propylene tetramer. The hydrocarbyl group may be derived from mixtures of monoolefins.

When the hydrocarbyl group on the carboxylic acid or anhydride is a polyalkene group, the polyalkene group is derived from a homopolymer or an interpolymer of polymerizable olefin monomers of 2 to about 16 carbon atoms, preferably 2 to about 6 carbon atoms, more preferably 3 to 4 carbon atoms. The interpolymers are those in which 2 or more olefin monomers are interpolymerized according to well known conventional procedures to form polyalkenes. The monoolefins are preferably ethylene, propylene, butylene, or octylene with butylene preferred. A preferred polyalkene group is a polybutenyl group. The above polyalkene group and succinic acids and anhydrides derived therefrom are disclosed in Meinhardt et al U.S. Pat. No. 4,234,435. The patent is incorporated by reference for its disclosure of polyalkene groups, succinic acids and anhydrides as well as procedures for making either of the same.

The polyalkene substituted carboxylic acids may be used in combination with the fatty alkyl or alkenyl substituted carboxylic acids. The fatty alkyl or alkenyl groups are those having from about 8 to about 30 carbon atoms. It is preferred that the polyalkene substituted carboxylic acids and the fatty substituted carboxylic acids are used in mixtures of an equivalent ratio of from about (0–1.5:1), more preferably about (0.5–1:1), more preferably about (1:1).

The above polycarboxylic acids or anhydrides are reacted with a hydroxy compound to form the wetting agents of the present invention. The hydroxy compounds may be polyhydric alcohols, hydroxy amines and hydroxy-containing polyoxyalkylene compounds. The hydroxy compounds include aliphatic or alkylenepolyols, polyoxyalkylene polyols, alkyl terminated polyoxyalkylene, polyoxyalkylene amines, polyoxyalkylated phenol, polyoxyalkylated fatty acids, polyoxyalkylated fatty amides, a polyoxyalkylated castor oil, and alkanolamines.

In one embodiment, the hydroxy compounds include polyhydric alcohols, such as alkylene polyols. Preferably, these polyhydric alcohols contain from 2 to about 40 carbon atoms, more preferably 2 to about 20; and from 2 to about 10 hydroxyl groups, more preferably 2 to about 6. Polyhydric alcohols include ethylene glycols, including di- and triethylene glycol; propylene glycols, including di- and tripropylene glycol; glycerol; butanediol; hexanediol; sorbitol; arabitol; mannitol; sucrose; fructose; glucose; cyclohexanediol; erythritol; and pentaerythritol; preferably, diethylene glycol, triethylene glycol; glycerol, sorbitol, pentaerythritol, and dipentaerythritol.

The polyhydric alcohols may be esterified with monocarboxylic acids having from 2 to about 30 carbon atoms, provided at least one hydroxyl group remains unesterified. Examples of monocarboxylic acids include acetic, propionic, butyric and fatty carboxylic acids. The fatty monocarboxylic acids have from about 8 to about 30 carbon atoms and include octanoic acid, oleic acid, stearic acid, linoleic acid, dodecanoic acid or tall oil acid. Specific examples of these esterified polyhydric alcohols include sorbitol oleate, including mono- and distearate, sorbitol stearate including mono- and distearate, glycerol oleate, including glycerol mono-, di- and trioleate, and erythritol octanoate.

The hydroxy compounds may also be polyoxyalkylene polyols. The polyoxyalkylene polyols include polyoxyalkylene glycols.

The polyoxyalkylene glycols may be polyoxyethylene glycols or polyoxypropylene glycols. Useful polyoxyethylene glycols are available from Union Carbide under the trade name Carbowax® PEG 300, 600, 1000 and 1450. The polyoxyalkylene glycols are preferrably polyoxypropylene glycols where the oxypropylene units are at least 80% of the total. The remaining 20% may be ethylene oxide or butylene oxide or other such esters, olefins and the like which may be polarized with polypropylene oxide. Useful polyoxypropylene glycols are available from Union Carbide under the trade name NIAX 425; and NIAX 1025. Useful polyoxypropylene glycols are available from Dow Chemical and sold by the trade name PPG-1200, and PPG-2000.

Representative of other useful polyoxyalkylene polyols are the liquid polyols available from Wyandotte Chemicals Company under the name PLURONIC Polyols and other similar polyols. These PLURONIC Polyols correspond to the formula $$HO-(CH_2CH_2O)_x(\underset{\underset{CH_3}{|}}{C}HCH_2O)_y(CH_2CH_2O)_z-H$$

wherein x, y, and z are integers greater than 1 such that the —$CH_2CH_2O$-groups comprise from about 10% to about 15% by weight of the total molecular weight of the glycol, the average molecular weight of said polyols being from about 2500 to about 4500. This type of polyol can be prepared by reacting propylene glycol with propylene oxide and then with ethylene oxide.

In another embodiment the hydroxy-compound is an alkyl terminated polyoxyalkylene. A variety of alkyl terminated polyoxyalkylenes are known in the art, and many are available commercially. The alkyl terminated polyoxyalkylenes are produced generally by treating an aliphatic alcohol with an excess of an alkylene oxide such as ethylene oxide or propylene oxide. For example, from about 6 to about 40 moles of ethylene oxide or propylene oxide may be condensed with the aliphatic alcohol.

The alkyl terminated polyoxyalkylenes useful in the present invention are available commercially under such trade names as "TRITON ®" from Rohm & Haas Company, "Carbowax ®" and "TERGITOL ®" from Union Carbide, "ALFONIC ®" from Conoco Chemicals Company, and "NEODOL ®" from Shell Chemical Company. The TRITON ® materials are identified generally as polyethoxylated alcohols or phenols. The TERGITOLS ® are identified as polyethylene glycol ethers of primary or secondary alcohols; the ALFONIC ® materials are identified as ethoxylated linear alcohols which may be represented by the general structural formula $$CH_3(CH_2)_dCH_2(OCH_2CH_2)_eOH$$

wherein d varies between 4 and 16 and e is a number between about 3 and 11. Specific examples of ALFONIC ® ethoxylates characterized by the above formula include ALFONIC ® 1012-60 wherein d is about 8 to 10 and e is an average of about 5 to 6; ALFONIC ®1214-70 wherein d is about 10-12 and e is an average of about 10 to about 11; ALFONIC ® 1412-60 wherein d is from 10-12 and e is an average of about 7; and ALFONIC ® 1218-70 wherein d is about 10-16 and e is an average of about 10 to about 11.

The Carbowax ® methoxy polyethylene glycols are linear ethoxylated polymer of methanol. Examples of these materials include Carbowax ® methoxy polyethylene glycol 350, 550 and 750, wherein the numerical value approximates molecular weight.

The NEODOL ® ethoxylates are ethoxylated alcohols wherein the alcohols are a mixture of alcohols containing from 12 to about 15 carbon atoms, and the alcohols are partially branched chain primary alcohols. The ethoxylates are obtained by reacting the alcohols with an excess of ethylene oxide such as from about 3 to about 12 or more moles of ethylene oxide per mole of alcohol. For example, NEODOL ® ethoxylate 23-6.5 is a partially branched chain alcoholate of 12 to 13 carbon atoms with an average of about 6 to about 7 ethoxy units.

In another embodiment, the hydroxy compound is a hydroxyamine. The hydroxyamine may be an alkanolamine or a polyoxyalkylated amine. The hydroxyamine may be primary, secondary or tertiary alkanol amines or mixtures thereof. Such amines may be represented by the formulae:

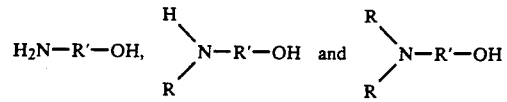

wherein each R is independently a hydrocarbyl group of one to about eight carbon atoms or hydroxyhydrocarbyl group of two to about eight carbon atoms and R′ is a divalent hydrocarbyl group of about two to about 18 carbon atoms. The group -R′-OH in such formulae represents the hydroxyhydrocarbyl group. R′ can be an acyclic, alicyclic or aromatic group. Typically, R′ is an acyclic straight or branched alkylene group such as an ethylene, 1,2-propylene, 1,2-butylene, or 1,2-octadecylene group, more preferably an ethylene or propylene group, more preferably an ethylene group. Where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperazines, -piperidines, -oxazolidines, -thiazolidines and the like. Typically, however, each R is independently a methyl, ethyl, propyl, butyl, pentyl, or hexyl group.

Examples of these alkanolamines include monoethanol amine, diethanol amine, triethanol amine, diethylethanol amine, ethylethanol amine, butyldiethanol amine, etc.

The hydroxyamines can also be an ether N-(hydroxyhydrocarbyl)amine. These are hydroxypoly(hydrocarbyloxy) analogs of the above-described alkanolamines (these analogs also include hydroxyl-substituted oxyalkylene analogs). Such N-(hydroxyhydrocarbyl) amines can be conveniently prepared by reaction of epoxides with afore-described amines and can be represented by the formulae:

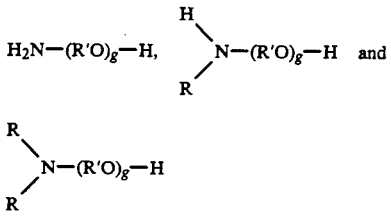

wherein g is a number from about 2 to about 15 and R and R′ are as described above. R may also be a hydroxypoly(hydrocarbyloxy) group.

In another embodiment, the hydroxy compound is a hydroxyamine, which can be represented by the formula

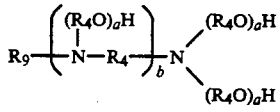

wherein each $R_4$ is an alkylene group, $R_9$ is a hydrocarbyl group; each a is independently an integer from zero to 100, provided at least one a is an integer greater than zero; and b is zero or one.

Preferably, $R_9$ is a hydrocarbyl group having from 8 to about 30 carbon atoms, preferably 8 to about 24, more preferably 10 to about 18 carbon atoms. $R_9$ is preferably an alkyl or alkenyl group, more preferably an alkenyl group. $R_9$ is preferably an octyl, decyl, dodecyl, tridecyl, tetradecyl, hexadecyl, octadecyl, oleyl, soya or tallow group.

a is preferably 1 to about 100, more preferably 2 to about 50, more preferably 2 to about 20, more preferably 3 to about 10, more preferably about 5.

$R_4$ is as described above. Preferably, each $R_4$ is independently an ethylene or propylene group.

The above hydroxyamines can be prepared by techniques well known in the art, and many such hydroxyamines are commercially available. They may be prepared, for example, by reaction of primary amines containing at least 6 carbon atoms with various amounts of alkylene oxides such as ethylene oxide, propylene oxide, etc. The primary amines may be single amines or mixtures of amines such as obtained by the hydrolysis of fatty oils such as tallow oils, sperm oils, coconut oils, etc. Specific examples of fatty acid amines containing from about 8 to about 30 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The useful hydroxyamines where b in the above formula is zero include 2-hydroxyethylhexylamine, 2-hydroxyethyloctylamine, 2-hydroxyethylpentadecylamine, 2-hydroxyethyloleylamine, 2-hydroxyethylsoyamine, bis(2-hydroxyethyl)hexylamine, bis(2-hydroxyethyl)oleylamine, and mixtures thereof. Also included are the comparable members wherein in the above formula at least one a is an integer greater than 2, as for example, 2-hydroxyethoxyethylhexylamine.

A number of hydroxyamines wherein b is zero are available from the Armak Chemical Division of Akzona, Inc., Chicago, Ill., under the general trade designation "Ethomeen" and "Propomeen". Specific examples of such products include "Ethomeen C/15" which is an ethylene oxide condensate of a cocoamine containing about 5 moles of ethylene oxide; "Ethomeen C/20" and "C/25" which also are ethylene oxide condensation products from cocoamine containing about 10 and 15 moles of ethylene oxide respectively; "Ethomeen 0/12" which is an ethylene oxide condensation product of oleylamine containing about 2 moles of ethylene oxide per mole of amine. "Ethomeen S/15" and "S/20" which are ethylene oxide condensation products with soyaamine containing about 5 and 10 moles of ethylene oxide per mole of amine respectively; and "Ethomeen T/12, T/15" and "T/25" which are ethylene oxide condensation products of tallowamine containing about 2, 5 and 15 moles of ethylene oxide per mole of amine respectively. "Propomeen 0/12" is the condensation product of one mole of oleyl amine with 2 moles propylene oxide. Preferably, the salt is formed from Ethomeen C/15 or S/15 or mixtures thereof.

Commercially available examples of hydroxyamines where b is 1 include "Ethoduomeen T/13", "T/20" and "T/25" which are ethylene oxide condensation products of N-tallow trimethylene diamine containing 3, 10 and 15 moles of ethylene oxide per mole of diamine, respectively.

Another group of hydroxyamines above are the commercially available liquid TETRONIC polyols sold by Wyandotte Chemicals Corporation. These polyols are represented by the general formula:

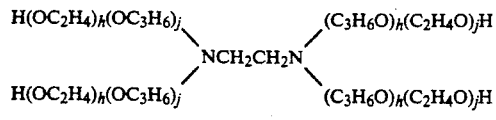

Such hydroxyamines are described in U.S. Pat. No. 2,979,528 which is incorporated herein by reference. Those hydroxyamines corresponding to the above formula having an average molecular weight of up to about 10,000 wherein the ethyleneoxy groups contribute to the total molecular weight in the percentage ranges discussed above are preferred. A specific example would be such a hydroxyamine having an average molecular weight of about 8000 wherein the ethyleneoxy groups account for 7.5%–12% by weight of the total molecular weight. Such hydroxyamines can be prepared by reacting an alkylene diamine such as ethylene diamine, propylene diamine, hexamethylene diamine etc., with propylene oxide. Then the resulting product is reacted with ethylene oxide.

In another embodiment, the hydroxy compound may be a propoxylated hydrazine. Propoxylated hydrazines are available commercially under the tradename Qxypruf TM. Examples of propoxylated hydrazines include Qxypruf TM 6, 12 and 20 which are hydrazine treated with 6, 12 and 20 moles of propylene oxide, respectively.

In another embodiment, the hydroxy compound may be a polyoxyalkylated phenol. The phenol may be substituted or unsubstituted. A preferred polyoxyalkylated phenol is a polyoxyethylate nonylphenol. Polyoxyalkylated phenols are availabe commercially from Rohn and Haas Co. under the tradename Triton ® and Texaco Chemical Company under tradename Surfonic ®. Examples of polyoxyalkylated phenols include Triton ® AG-98, N series, and X series polyoxyethylated nonylphenols.

In another embodiment, the hydroxy compound may be a polyoxyalkylene fatty ester. Polyoxyalkylene fatty esters may be prepared from any polyoxyalkylene polyol and a fatty acid. Preferably, the polyoxyalkylene polyol is any disclosed herein. The fatty acid is preferably the fatty monocarboxylic acid described above. Polyoxyalkylene fatty esters are available commercially from Armak Company under the tradename Ethofat TM. Specific examples of polyoxyalkylene fatty esters include Ethofat TM C/15 and C/25, which are coco fatty esters formed using 5 and 15 moles, respectively, of ethylene oxide; Ethofat TM 0/15 and 0/20, which are oleic esters formed using 5 and 10 moles of ethylene oxide; and Ethofat 60/15, 60/20 and 60/25 which are stearic esters formed with 5, 10 and 15 moles of ethylene oxide respectively.

In another embodiment, the hydroxy compound may also be a polyoxyalkylated fatty amide. Preferably the fatty amide is polyoxypropylated or polyoxyethylated, more preferably polyoxyethylated. Examples of fatty acids which may be polyoxyalkylated include oleylamide, stearylamide, tallowamide, soyaamide, cocoamide, and laurylamide. Polyoxyalkylated fatty amides are available commercially from Armak Company under the trade name Ethomid TM and Lonza, Inc., under the tradename Unamide ®. Specific examples of these polyoxyalkylated fatty amides include Ethomid TM HT/15 and HT/60, which are hydrogenated tallow acid amides treated with 5 and 50 moles of ethylene oxide respectively; Ethomid TM 0/15, which is an oleic amide treated with 5 moles of ethylene oxide; Unamide ® C-2 and C-5, which are cocamides treated with 2 and 5 moles of ethylene oxide, respectively; and Unamide ® L-2 and L-5, which are lauramides treated with 2 and 5 moles of ethylene oxide, respectively.

The ester-acids of the present invention may be prepared from a hydroxyl-containing compound and a carboxylic acid or anhydride by conventional esterification techniques. When a carboxylic anhydride is used, the ester-acid is formed by a ring opening reaction between the hydroxyl compound and the anhydride. The reaction occurs between about ambient temperature and the decomposition temperature of any of the reactants or the reaction mixture, more preferably about 50° C. to 250° C., more preferably about 70° C. to 175° C. The hydroxyl compound and carboxylic acid or anhydride are reacted at an equivalent ratio from, preferably about (1:1.5–4), more preferably (1:2).

The wetting agents of the present invention may be used as acids or salts. The salts may be prepared from any of the ester-acids described above. When the wetting agent is a salt, M is an ammonium or metal cation, preferably an ammonium cation.

When M is a metal cation, the metal cation may be an alkali metal, alkaline earth metal or transition metal cation, preferably an alkali metal, or an alkaline earth metal cation, more preferably an alkali metal cation. Specific examples of metal cations include sodium, potassium, calcium, magnesium, zinc or aluminum cation, more preferably sodium or potassium. The metal cations are formed by treating an ester-acid with a metal oxide, hydroxide, or halide. The metal salt is formed between ambient room temperature and about 120° C., more preferably room temperature to about 80° C.

When M is an ammonium cation, the ammonium cation may be derived from ammonia or any amine. The ammonium cation may be derived from any of the amines described herein. The ammonium cation may be derived from the hydroxyamine forming the ester, and is therefore an internal salt. Preferably, the salt is formed from alkyl monoamines, or hydroxy amine. The hydroxy amines are described above.

The alkyl monoamines are primary secondary or tertiary monoamines. The alkyl monoamines generally contain from 1 to about 24 carbon atoms in each alkyl group, preferably from 1 to about 12, and more preferably from 1 to about 6. Examples of monoamines useful in the present invention include methylamine, ethylamine, propylamine, butylamine, octylamine, and dodecylamine. Examples of secondary amines include dimethylamine, dipropylamine, dibutylamine, methylbutylamine, ethylhexylamine, etc. Tertiary amines include trimethylamine, tributylamine, methyldiethylamine, ethyldibutylamine, etc.

The following are examples of the above wetting agents which may be used to treat polymer fabrics. Unless otherwise indicated, temperature is degrees Celsius, and parts are parts by weight. Neutralization number is the amount of potassium hydroxide required to neutralize one gram of sample. Neutralization number is expressed in milligrams of potassium hydroxide or mg KOH.

EXAMPLE 1

A reaction vessel, equipped with a mechanical stirrer and thermometer, is charged with 224 parts (0.8 mole) of tetrapropylene-substituted succinic anhydride, 72 parts (0.4 mole) of sorbitol and 20 milliliters of toluene. The reaction mixture is heated to 135° C. where 0.3 part of anhydrous sodium acetate is added to the mixture. The reaction mixture is stirred for 3.5 hours at 135° C. Toluene is removed by nitrogen blowing at 135° C. for about one-half hour. The product is a sticky amber semi-solid which has a neutralization number to phenolphthalein of 160 mg KOH (theoretical 152).

An ammonium salt is prepared by adding 30 parts of the above product, 270 parts of cold tap water and 6.5 parts of concentrated ammonium hydroxide to a reaction vessel. The mixture is stirred for one-quarter hour at room temperature to produce the salt.

EXAMPLE 2

A reaction vessel, equipped with a mechanical stirrer, thermometer and nitrogen sparge, is charged with 165 parts (0.15 mole) of a polybutenyl-substituted succinic anhydride having a polybutenyl group having a number average molecular weight of about 950, and 42 parts (0.15 mole) of the succinic anhydride of Example 1. The anhydrides are stirred and heated to 90° C. where 27 parts (0.15 mole) of sorbitol, 0.25 part of anhydrous sodium acetate and 20 milliliters of toluene are added to the vessel. The mixture is heated to 140° C. and held with stirring for 4 hours under a nitrogen sparge of 0.2 standard cubic foot per hour (SCFH). The toluene is removed by nitrogen sparging at 1 SCFH at 140° C. for one-half hour. The product is a dark red-amber liquid having a neutralization number to phenolphthalein of 72.

An ammonium salt of the above product is prepared by dissolving 30 parts (0.038 equivalent) of the above product and 270 parts of tap water and 3.0 grams (0.044 equivalent) concentrated ammonium hydroxide. The mixture is stirred at room temperature for one-quarter hour to produce the salt.

EXAMPLE 3

A reaction vessel is charged with 165 parts (0.15 mole) of the polybutentyl succinic anhydride of Example 2, 42 parts (0.15 mole) of the tetrapropylene succinic anhydride of Example 1 and 45 parts (0.15 mole) of PEG-300, having approximately 300 molecular weight, available from Union Carbide Chemical Company. Then, 0.25 part of anhydrous sodium acetate and 20 milliliters of toluene are added to the reaction vessel. The mixture is heated to 140° C. and held for 3.5 hours with stirring. The toluene is removed by nitrogen blowing at 0.5 SCFH at 140° C. The product is a red-amber viscous liquid having a neutralization number to phenolphthalein of 72 mg KOH (theoretical 67).

An ammonium salt of the above product is prepared by dissolving 30 parts (0.037 equivalent) of the above product in 270 parts of tap water and 3.0 parts (0.045 equivalent) of concentrated ammonium hydroxide. The mixture is stirred at room temperature for one-quarter hour to produce a salt.

EXAMPLE 4

A reaction vessel, equipped with a mechanical stirrer, a thermometer and a nitrogen inlet, is charged with 133 parts (0.5 equivalent) of the succinic anhydride of Example 1 and 150 parts (0.5 equivalent) of Carbowax 300, a polyoxyethylene glycol having approximately 300 molecular weight available from Union Carbide Chemical Co. The mixture is heated with stirring and nitrogen blowing at 0.3 SCFH to 150° C. and held for one hour.

The product has a neutralization number to phenolphthalein of 103.5 mg KOH.

An ammonium salt of the above product is prepared by adding 100 parts (0.19 equivalent) of the above product to 90 parts of water and 10.5 parts (0.19 equivalent) concentrated ammonium hydroxide. The mixture is stirred for one-quarter hour at room temperature. The 50% aqueous solution has a pH of 7.0–7.5.

EXAMPLE 5

A vessel, equipped with a thermometer and a stirrer, is charged with 192 parts (0.5 mole) of Ethomeen C-15 and 130 parts (0.5 mole) of the succinic anhydride of Example 1. The reaction is exothermic. The reaction mixture is then heated to 110° C. and held for 2 hours. Infrared spectrum of the product shows no anhydride absorption peaks at 1770 $CM^{-1}$ and 1840 $CM^{-1}$. The product has a neutralization number of 84 mg KOH.

EXAMPLE 6

A vessel, equipped with a thermometer and a stirrer, is charged with 133 parts (0.5 mole) of the succinic anhydride of Example 1 and 74.5 parts (0.5 mole) of triethanol amine. The reaction is exothermic to 80° C. The reaction mixture is heated to 110° C. and held for one hour.

EXAMPLE 7

A reaction vessel is charged with 166 parts (0.5 mole) of a isomerized $C_{16}$ alpha-olefin substituted succinic anhydride and 74.5 parts (0.5 mole) of triethanolamine. The mixture is stirred on a roller for one-fourth hour. The vessel is heated to 100° C. and stirred on a roller for one-fourth hour.

EXAMPLE 8

A reaction vessel is charged with 47 parts (0.05 mole) of Ethoduomeen T-25 and 26 parts (0.1 mole) of the succinic anhydride of Example 1. The mixture is heated to 110–120° C. and held for 2 hours with stirring. The product has a neutralization number to phenolphthalein of 60 mg KOH (theoretical 76).

An amine salt of the above product was made by mixing 9.4 parts (0.01 equivalent) of the above product with 3.8 parts (0.01 equivalent) of Ethomeen C-15. The product is a dark amber viscous liquid.

EXAMPLE 9

Following the procedure of Example 8, 39 parts (0.15 mole) of the succinic anhydride of Example 1 and 47 parts (0.05 mole) of Ethoduomeen T-25 are reacted to form a product which has a neutralization number to phenolphthalein of 89 mg KOH (theoretical 97). An ammonium salt of the above product is prepared by mixing 6.3 parts (0.01 equivalent) of the above product with 3.8 parts (0.01 equivalent) of Ethomeen C-15.

EXAMPLE 10

Following the procedure of Example 8, 26 parts (0.1 mole) of the succinic anhydride of Example 1 and 57 parts (0.1 mole) of Ethomeen C-15 are reacted to form a product which had a neutralization number to phenolphthalein of 74 mg KOH (theoretical 67). An ammonium salt of the above product is prepared by mixing 8.4 parts (0.01 equivalent) of the above product with 3.8 parts (0.01 equivalent) of Ethomeen C-15.

EXAMPLE 11

Following the procedure of Example 8, 26 parts (0.1 mole) of the succinic anhydride of Example 1 and 42 parts (0.1 mole) of Unamide C-15, a cocamide treated with 5 moles of ethylene oxide, are reacted to form a product which had the neutralization number to phenolphthalein of 89 mg KOH (theoretical 82). An ammonium salt of the above product is prepared by mixing 6.3 parts (0.01 equivalent) of the above product with 3.8 parts (0.01 equivalent) of Ethomeen C-15.

EXAMPLE 12

Following the procedure of Example 8, 26 parts (0.1 mole) of the succinic anhydride of Example 1 and 58 parts (0.1 mole) of Polyethylene Glycol 400 monolaurate are reacted to give a product which has a neutralization number to phenolphthalein of 71 (theoretical 66). An ammonium salt of the above product is prepared by reacting 7.9 parts (0.01 equivalent) of the above product with 3.8 parts (0.01 equivalent) of Ethomeen C-15.

The wetting agents of the present invention are usually applied to the fabric as a 0.25 to about 2%, more preferably 0.5 to about 1%, more preferably 0.5 to about 0.75% by weight organic or aqueous mixture. The mixture may be a solution or dispersion. The organic mixture may be prepared by using volatile organic solvents. Useful organic solvents include alcohols, such as alcohols having from 1 to about 6 carbon atoms, including butanol and hexanol; or ketones, such as acetone or methylethylketone. Preferably the wetting agents are applied as an aqueous solution or dispersion. The wetting agents may be applied either by spraying the fabric or dipping the fabric into the mixture. After application of the wetting agents, the treated fabric is dried by any ordinary drying procedure such as drying at 120° C. for approximately 3 to 5 minutes.

A cowetting agent may be used to reduce wetting time of the above aqueous mixture. The cowetting agent is preferably a surfactant, more preferably a nonionic surfactant, more preferably a nonionic surfactant. Useful surfactants include the above described alkyl terminated polyoxyalkylenes, and alkoxylated phenols. Preferably, the surfactant is an alkyl terminated polyoxyalkylene.

The wetting time of the wetting agent mixture may also be reduced by heating the mixture. Usually the wetting agents are applied at room temperature. However, a 10°–15° C. increase in temperature significantly reduces wetting time.

Preferably, after drying the treated polymer fabrics have from about 0.1 to about 3%, more preferably about 0.1 to about 1%, more preferably 0.5 to about 0.8% pickup based on the weight of the fabric. Percent pickup is the percentage by weight of wetting agent on a polymer fabric.

The following Table contains examples of polypropylene fabrics treated with aqueous solutions or dispersions of wetting agents. The polymer fabric may be any polypropylene fabric available commercially. The aqueous solution or dispersion contains a wetting agent in the amount shown in the Table. The polypropylene fabric is dipped into the aqueous solution or dispersion and then dried for 3–5 minutes at 125° C.

TABLE

| Examples | Wetting Agent | Amount Wetting Agent In Water |
|---|---|---|
| A | Example 1 | 1% |
| B | Example 3 | 0.75% |
| C | Example 6 | 0.5% |
| D | Example 8 | 0.75% |

The treated polymer fabrics have improved hydrophilic character. The treated fabrics show an improvement in the wicking/wetting ability of the fabrics. The polymer fabrics of the present invention may be formed into diapers, feminine products, surgical gowns, breathable clothing liners and the like by procedures known to those in the art.

The properties of the treated fabrics or products made with the fabrics may be measured by ASTM Method E 96-80, Standard Test Methods for Water Vapor Transmission of Materials, and INDA Standard Test 80 7-70 (82), INDA Standard Test for Saline Repellency of Nonwovens, often referred to as the Mason Jar Test. The later test uses a 0.9% by weight saline solution.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. An article comprising:

(A) a hydrophobic polymer fabric treated with (B) a wetting agent which comprises at least one compound of the formula

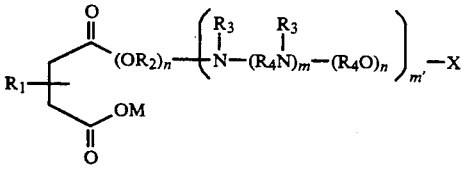

wherein $R_1$ is a hydrocarbyl group having about 8 to about 150 carbon atoms; $R_2$ is a hydrocarbylene group, or a hydroxy substituted or hydroxyalkyl substituted hydrocarbylene; each $R_3$ is independently hydrogen, an alkyl group, a hydroxyalkyl group, a hydrocarbylcarbonyl or a polyoxyalkylene group; each $R_4$ is independently a hydrocarbylene group; each n is independently 1 to 150; m is zero or one; m' is zero or one; M is a hydrogen, an ammonium cation or a metal cation, and when m' is zero, X is —H, —Ar, —OH, —$OR_5$,

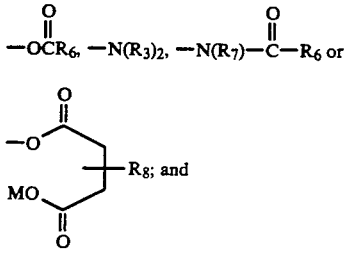

when m' is one, X is —H, —$R_5$,

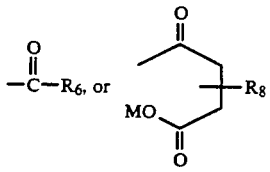

wherein each $R_5$, $R_6$ and $R_8$ is independently a hydrocarbyl group having up to 100 carbon atoms; $R_7$ is hydrogen or an alkyl group having from 1 to about 8 carbon atoms and Ar is a phenyl group.

2. The article of claim 1, wherein $R_2$ is an alkylene group having 2 to about 8 carbon atoms or a hydroxy substituted or hydroxyalkyl substituted alkylene having from 2 to about 10 carbon atoms; each $R_4$ is independently an alkylene group having 2 to about 8 carbon atoms; and each n is independently from 1 to about 20.

3. The article of claim 1, wherein $R_1$ is an alkyl or alkenyl group having from about 8 to about 30 carbon atoms, a polyalkene substituent having a number average molecular weight from about 400 to about 2000, or mixtures thereof.

4. The article of claim 1, wherein $R_1$ is an alkyl or alkenyl group having from about 8 to about 24 carbon atoms.

5. The article of claim 1, wherein $R_1$ is a polyalkene group having a number average molecular weight from about 900 to about 1100.

6. The article of claim 1, wherein m is zero, m' is one and $R_3$ is an alkyl or alkenyl group having from about 8 to about 30 carbon atoms or a hydroxyalkyl group having from 1 to about 8 carbon atoms.

7. The article of claim 1, wherein m is zero, m' is one and $R_3$ is a polyoxyethylene or polyoxypropylene group.

8. The article of claim 1, wherein m is zero, m' is one and $R_3$ is an alkylcarbonyl group wherein the alkyl group contains from about 8 to about 30 carbon atoms.

9. The article of claim 1, wherein m is one, m' is one, and $R_3$ is a hydrogen or an alkyl group having from 8 to about 30 carbon atoms.

10. The article of claim 1, wherein m equals zero, m' is one and X is

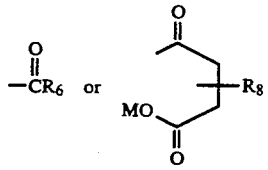

wherein each $R_6$ and $R_8$ is independently an alkyl or alkenyl group having from about 8 to about 150 carbon atoms.

11. The article of claim 1, wherein m' is zero and X is —OH, —$OR_5$,

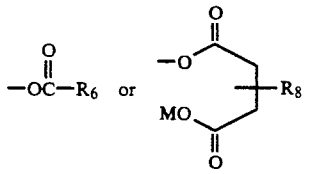

wherein $R_5$ is an alkyl group having from 1 to about 30 carbon atoms and each $R_6$ and $R_8$ is independently an alkyl or alkenyl group having from about 8 to about 150 carbon atoms.

12. The article of claim 1, wherein M is hydrogen.

13. The article of claim 1, wherein M is an ammonium cation derived from a hydroxyamine or ammonia.

14. The article of claim 1, wherein M is derived from an hydroxyamine represented by the formula

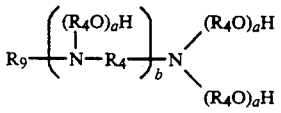

wherein each $R_4$ is independently an alkylene group; $R_9$ is an alkyl or alkenyl group having about 8 to about 30 carbon atoms; each a is independently 1 to 100; and b is zero or one.

15. The article of claim 14, wherein each $R_4$ is independently ethylene or propylene; $R_9$ is an alkyl or alkenyl group having from 8 to about 24 carbon atoms; each a is independently 1 to about 20; and b is zero.

16. The article of claim 11, wherein $R_9$ is an octyl, decyl, dodecyl, tridecyl, tetradecyl, hexadecyl, octadecyl, oleyl, tallow or soya group.

17. The article of claim 1, wherein M is a metal cation.

18. The article of claim 14, wherein the cation is a sodium, potassium, calcium, magnesium, zinc or aluminum cation.

19. The article of claim 1, wherein the fabric (A) is nonwoven.

20. The article of claim 1, wherein the fabric (A) is a polyethylene or polypropylene fabric.

21. An article comprising:

(A) a hydrophobic polymer fabric treated with (B) a wetting agent which comprises at least one compound of the formula

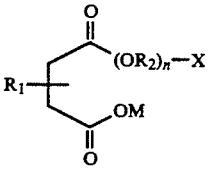

wherein $R_1$ is an alkyl or alkenyl group having from about 8 to about 150 carbon atoms; each $R_2$ is independently an alkylene group or a hydroxy substituted or hydroxyalkyl substituted alkylene group; n is 1 to about 100; M is a hydrogen, a metal cation or an ammonium cation; and X is $—OR_5$,

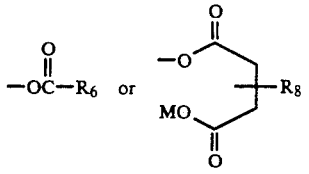

wherein $R_5$ is an alkyl or alkenyl group having about 1 to about 30 carbon atoms and each $R_6$ and $R_8$ is independently an alkyl or alkenyl group having about 8 to about 150 carbon atoms.

22. The article of claim 21, wherein each $R_1$ independently contains about 8 to 28 carbon atoms, $R_2$ is an alkylene group having 2 to about 4 carbon atoms or a hydroxy or hydroxyalkyl substituted alkylene having from 2 to about 10 carbon atoms, n is 1 to about 20, and each $R_6$ and $R_8$ independently has from about 8 to about 30 carbon atoms.

23. The article of claim 21; wherein M is an ammonium cation derived from an hydroxyamine represented by the formula

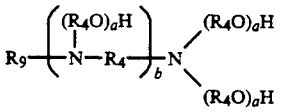

wherein $R_9$ is an alkyl or alkenyl group having about 8 to about 30 carbon atoms; each $R_4$ is independently an alkylene group; each a is independently 1 to 100; and b is zero or one.

24. The article of claim 23, wherein $R_4$ is an ethylene or propylene group, and $R_9$ is an alkyl or alkenyl group having from 8 to about 24 carbon atoms, each a is independently 1 to about 20, and b is zero.

25. The article of claim 21, wherein M is hydrogen.

26. The article of claim 21, wherein M is a metal cation which is a sodium, potassium, calcium, magnesium or aluminum cation.

27. The article of claim 21, wherein the fabric (A) is nonwoven.

28. The article of claim 21, wherein the fabric (A) is a polyethylene or polypropylene fabric.

29. An article, comprising:

(A) at least one hydrophobic polymer fabric treated with (B) at least one wetting agent which is the reaction product of a succinic acid or anhydride having a hydrocarbyl group containing from 8 to about 150 carbon atoms and a hydroxy compound selected from the group consisting of aliphatic or alkylene polyol, polyoxyalkylene polyol, alkyl terminated polyoxyalkylene, polyoxyalkylene amine, polyoxyalkylene glycol fatty ester, polyoxyalkylated phenol, polyoxyalkylated fatty amide, polyoxyalkylated castor oil, and alkanolamine.

30. The article of claim 29, wherein the hydrocarbyl group contains from about 8 to about 30 carbon atoms.

31. The article of claim 29, wherein the hydrocarbyl group is an octyl, decyl, dodecyl, tridecyl, tetradecyl, hexadecyl, octadecyl, dodecenyl, tetradecenyl, hexadecenyl, octadecenyl, oleyl, soya or propylene tetramer group.

32. The article of claim 29, wherein the hydrocarbyl group has a number average molecular weight from about 900 to about 1100.

33. The article of claim 29, wherein the polyoxyalkylene groups are polyoxyethylene group, polyoxypropylene group or mixtures thereof.

34. The article of claim 29, wherein the hydroxy compound is a polyoxyalkylene diol, an alkyl terminated polyoxyalkylene or an alkylenepolyol 35. The article of claim 29, wherein the hydroxy compound is pentaerythritol, glycerol, sorbitol, dipentaerythritol or ethylene glycol.

36. The article of claim 29, wherein the wetting agent is a salt of the reaction product.

37. The article of claim 36, wherein the salt is derived from an hydroxyamine represented by the formula

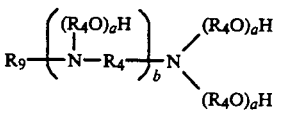

wherein each $R_4$ is independently an alkylene group; $R_9$ is an alkyl or alkenyl group having about 8 to about 30 carbon atoms; each a is independently 1 to 100; and b is zero or one.

38. The article of claim 37, wherein $R_4$ is an ethylene or propylene group; $R_9$ is an alkyl or alkenyl group having from 8 to about 24 carbon atoms; each a is independently 1 to about 20; and b is zero.

39. The article of claim 36, wherein the salt is a metal salt, wherein the metal of the metal salt is sodium, potassium, calcium, magnesium, zinc or aluminum.

40. The article of claim 29, wherein the fabric (A) is nonwoven.

41. The article of claim 29, wherein the polymer of the fabric is polyethylene or polypropylene.

42. A process for improving the hydrophilic characteristics of a hydrophobic polymer fabric, comprising the steps of: treating with a wetting agent which comprises at least one compound of the formula

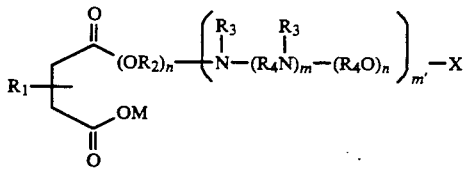

wherein $R_1$ is a hydrocarbyl group having about 8 to about 150 carbon atoms; $R_2$ is a hydrocarbylene group, or a hydroxy substituted or hydroxyalkyl substituted hydrocarbylene; each $R_3$ is independently hydrogen, an alkyl group, a hydroxyalkyl group, a hydrocarbylcarbonyl or a polyoxyalkylene group; each $R_4$ is independently a hydrocarbylene group; each n is independently 1 to 150; m is zero or one; m' is zero or one; M is a hydrogen, an ammonium cation or a metal cation; and when m' is zero, X is —H, —Ar, —OH, —$OR_5$,

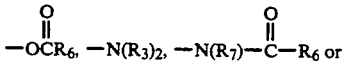

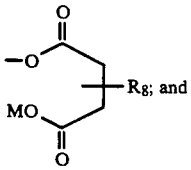

when m' is one, X is —H, —$R_5$,

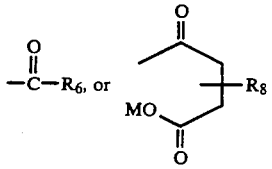

wherein each $R_5$, $R_6$ and $R_8$ is independently a hydrocarbyl group having up to 100 carbon atoms; $R_7$ is hydrogen or an alkyl group having from 1 to about 8 carbon atoms and Ar is a phenyl group.

43. A diaper prepared from the article of claim 1.

44. A diaper prepared from the article of claim 21.

45. A diaper prepared from the article of claim 29.

* * * * *

UNITED STATES PATENT AND TRADEMARK OFFICE

CERTIFICATE OF CORRECTION

PATENT NO. : 5,209,966

DATED : May 11, 1993

INVENTOR(S) : Lange et al.

It is certified that error appears in the above-indentified patent and that said Letters Patent is hereby corrected as shown below:

Column 19, line 47, of claim 42, delete "treating with a wetting agent" and insert --treating the fabric with a wetting agent--.

Signed and Sealed this

Nineteenth Day of April, 1994

Bruce Lehman

*Attest:*

BRUCE LEHMAN

*Attesting Officer*

*Commissioner of Patents and Trademarks*